US009828684B2

(12) United States Patent
Asaumi et al.

(10) Patent No.: US 9,828,684 B2
(45) Date of Patent: Nov. 28, 2017

(54) CELL FOR ION EXCHANGE MEMBRANE ELECTROLYSIS

(71) Applicant: CHLORINE ENGINEERS CORP., LTD., Tokyo (JP)

(72) Inventors: Kiyohito Asaumi, Tamano (JP); Koichi Hirashima, Tamano (JP); Zhengkan Huang, Tamano (JP); Mitsumasa Okamoto, Tamano (JP); Koji Yoshimura, Tamano (JP)

(73) Assignee: thyssenkrupp Uhde Chlorine Engineers (Japan) Ltd., Tokyo (JP)

( * ) Notice: Subject to any disclaimer, the term of this patent is extended or adjusted under 35 U.S.C. 154(b) by 185 days.

(21) Appl. No.: 14/396,143

(22) PCT Filed: Apr. 23, 2013

(86) PCT No.: PCT/JP2013/061958

§ 371 (c)(1),
(2) Date: Oct. 22, 2014

(87) PCT Pub. No.: WO2013/161836

PCT Pub. Date: Oct. 31, 2013

(65) Prior Publication Data

US 2015/0114830 A1 Apr. 30, 2015

(30) Foreign Application Priority Data

Apr. 27, 2012 (JP) ..... 2012-103978

(51) Int. Cl.
*C25B 9/08* (2006.01)
*C25B 9/02* (2006.01)
*C25B 1/46* (2006.01)

(52) U.S. Cl.
CPC ..... *C25B 9/08* (2013.01); *C25B 1/46* (2013.01); *C25B 9/02* (2013.01)

(58) Field of Classification Search
CPC .... C25B 9/08; C25B 9/10; C25B 1/10; C25B 9/00; C25D 17/002; C25D 17/00; C25D 17/10
(Continued)

(56) References Cited

U.S. PATENT DOCUMENTS 4,101,410 A * 7/1978 Kircher ..... C25B 11/02 204/266
5,360,526 A 11/1994 Arimoro et al.
(Continued)

FOREIGN PATENT DOCUMENTS

CN 1292043 A 4/2001
CN 1537973 A 10/2004
(Continued)

OTHER PUBLICATIONS

International Search Report dated May 28, 2013 for International Application No. PCT/JP2013/061958.
(Continued)

*Primary Examiner* — Harry D Wilkins, III
(74) *Attorney, Agent, or Firm* — Birch, Stewart, Kolasch & Birch, LLP

(57) ABSTRACT

Provided is a cell for ion exchange membrane electrolysis obtained by improving the performance in electrolysis of an existing bipolar cell for ion exchange membrane electrolysis, in which a cathode partition wall and a rigid cathode being connected together by a plurality of intermediating V-shaped springs, by a simple method. It is a cell for ion exchange membrane electrolysis which is separated by an ion exchange membrane (7) into an anode chamber (1) having a rigid anode (1*a*) and an anode partition wall (1*b*) and a cathode chamber (2) having a rigid cathode (2*a*) and a cathode partition wall (2*b*), the rigid cathode (2*a*) and the cathode partition wall (2*b*) being connected together by a
(Continued)

plurality of intermediating V-shaped springs (3). It is a cell for ion exchange membrane electrolysis in which a metal elastic body (5) and a flexible cathode (6) are disposed in layers on the surface of the rigid cathode (2*a*), the surface being opposite to the surface to which the V-shaped springs (3) are attached, and a conductive member (4) is disposed near one end on the opening side of a V-shaped spring (3), which conductive member (4) is electrically connected with the V-shaped spring (3) when the V-shaped spring (3) is compressed.

9 Claims, 5 Drawing Sheets

(58) Field of Classification Search
USPC ..... 204/252
See application file for complete search history.

(56) References Cited

U.S. PATENT DOCUMENTS

| | | | | |
|---|---|---|---|---|
| 6,495,006 | B1 | 12/2002 | Kimura et al. | |
| 2003/0188966 | A1 | 10/2003 | Katayama | |
| 2004/0188245 | A1 | 9/2004 | Katayama et al. | |
| 2007/0068799 | A1 | 3/2007 | Shinomiya et al. | |
| 2007/0235338 | A1* | 10/2007 | Kodama | C25B 9/08 204/627 |
| 2007/0278095 | A1* | 12/2007 | Asaumi | C25B 9/04 204/297.14 |
| 2008/0053821 | A1 | 3/2008 | Suzuki et al. | |
| 2012/0241314 | A1* | 9/2012 | Madono | C25B 11/035 204/252 |

FOREIGN PATENT DOCUMENTS

| | | | |
|---|---|---|---|
| CN | 101074481 | A | 11/2007 |
| CN | 101187036 | A | 5/2008 |
| EP | 1378589 | A1 | 1/2004 |
| EP | 1767671 | A2 | 3/2007 |
| JP | 57-108278 | A | 7/1982 |
| JP | 63-53272 | A | 3/1988 |
| JP | 5-306484 | A | 11/1993 |
| JP | 2004-300543 | A | 10/2004 |
| JP | 2009-242922 | A | 10/2009 |
| JP | 2011-117047 | A | 6/2011 |
| WO | WO 02/103082 | A1 | 12/2002 |
| WO | WO 2013/161836 | A1 | 10/2013 |

OTHER PUBLICATIONS

Supplementary European Search Report, dated Dec. 1, 2015, for European Application No. 13780850.7.
Chinese Office Action and Search Report, dated May 4, 2016, for Chinese Application No. 201380022395.9.

* cited by examiner

[Fig.1]
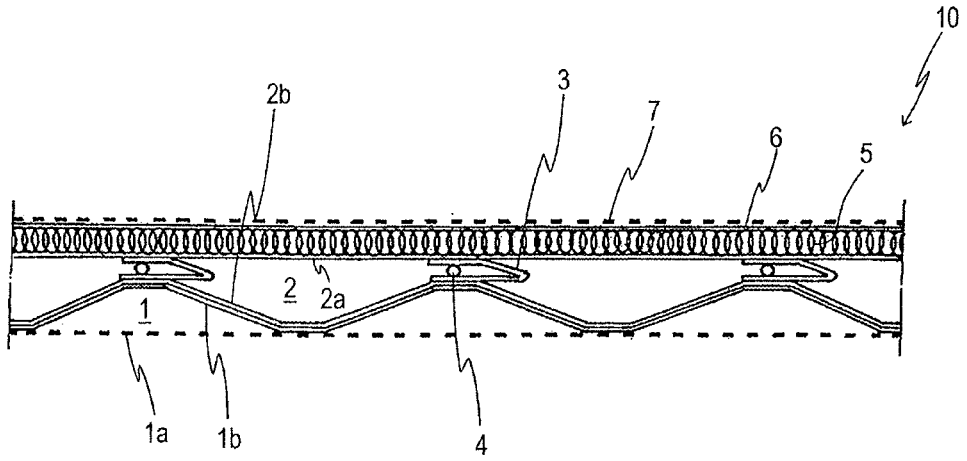
[Fig.2]
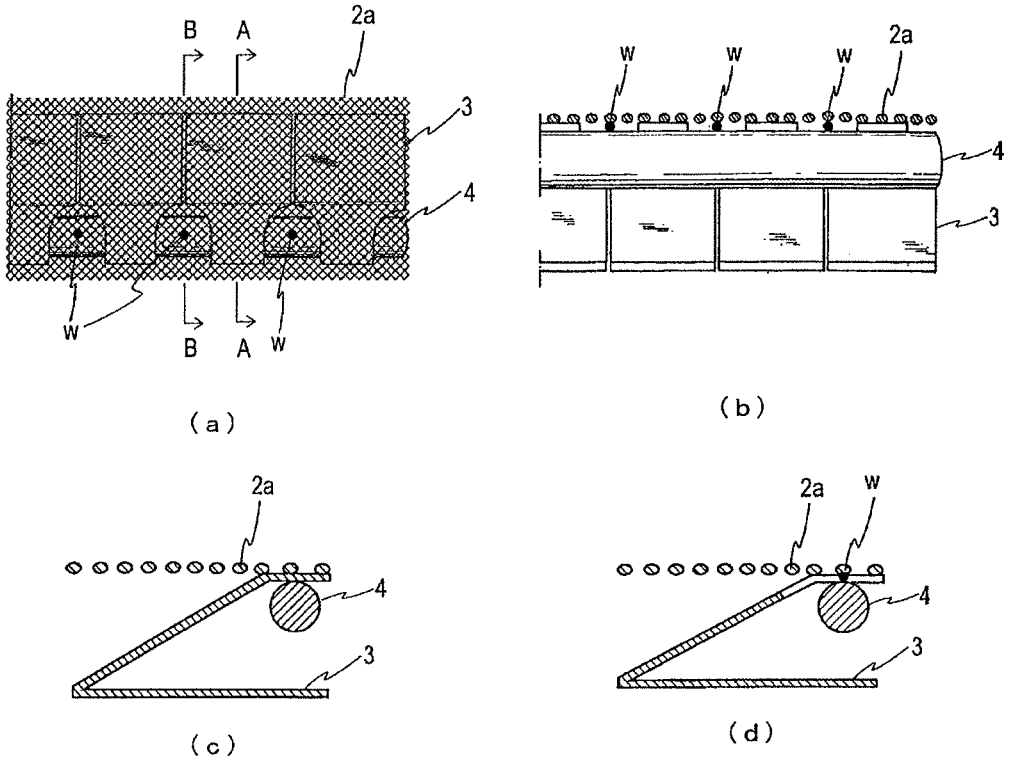

[Fig.3]
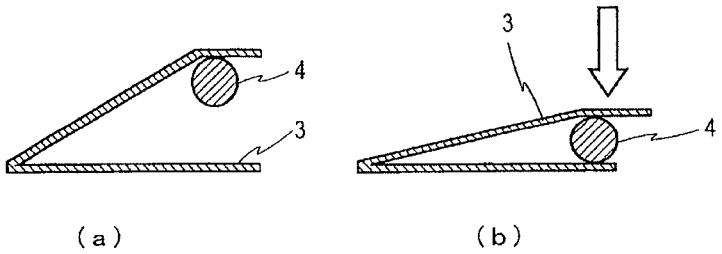
[Fig.4]
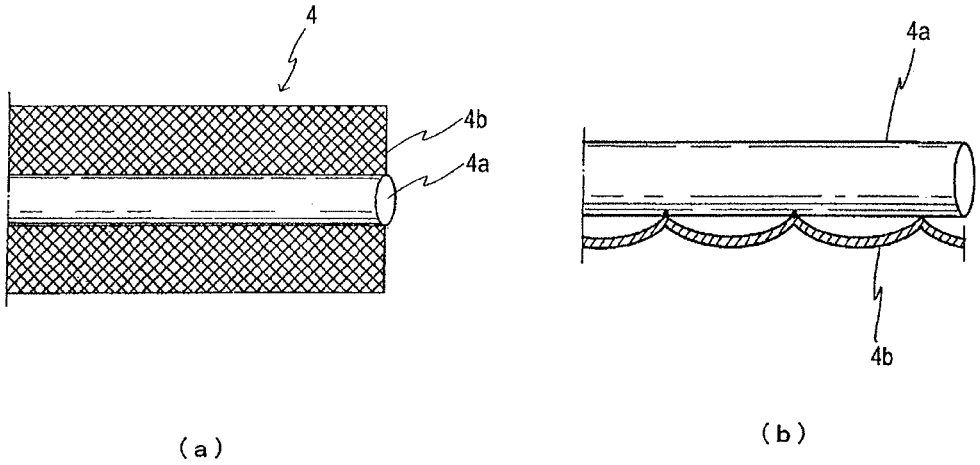
[Fig.5]
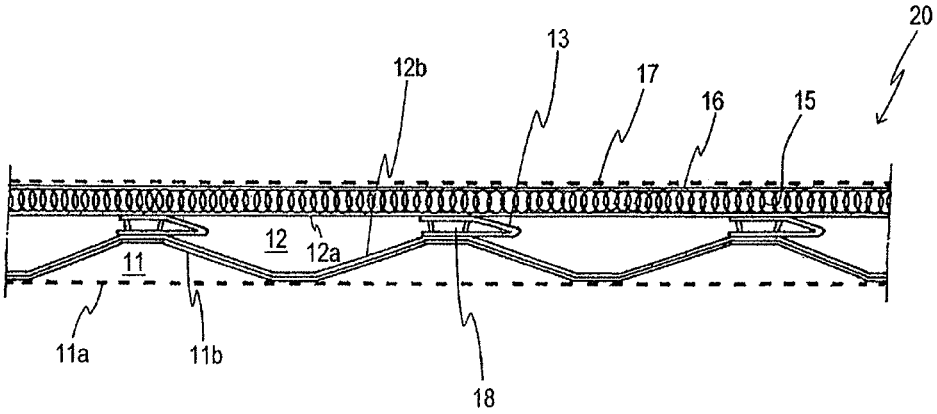

[Fig.6]
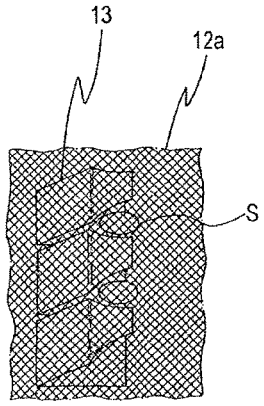
[Fig.7]
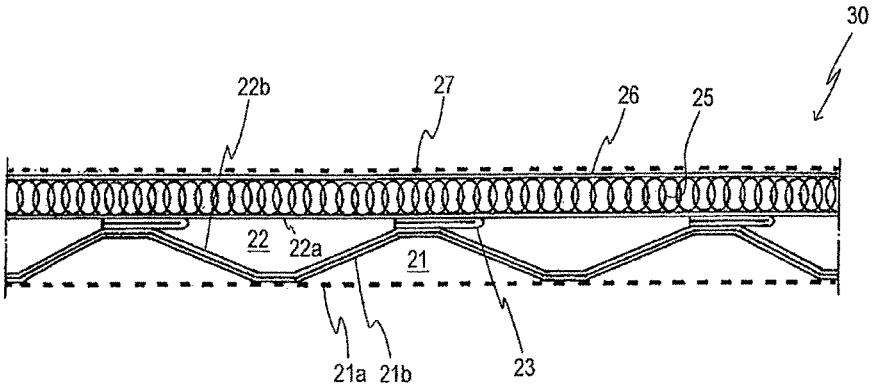
[Fig.8]
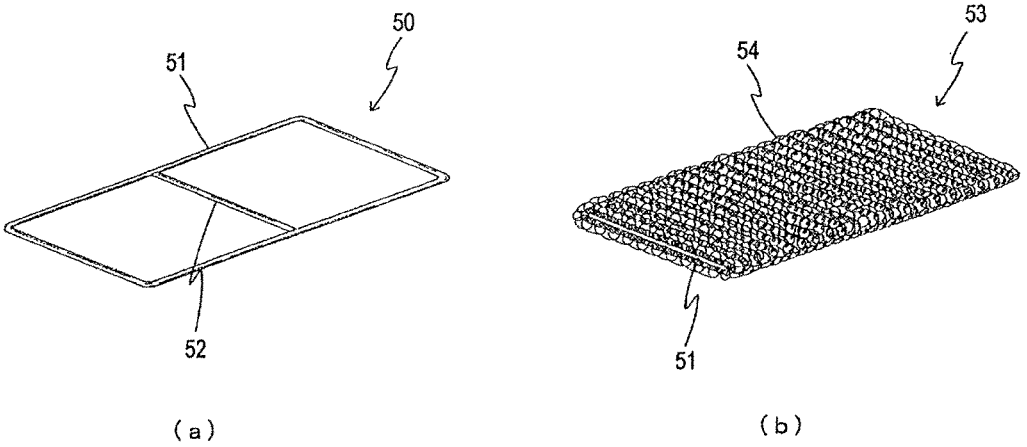

[Fig.9]
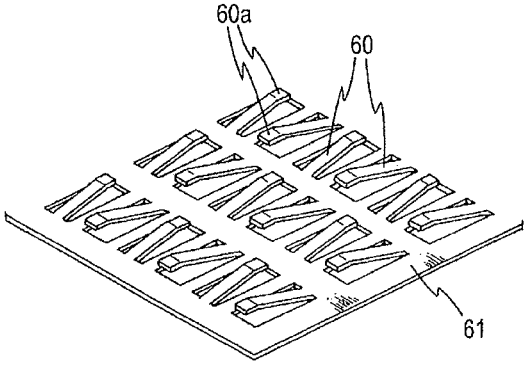
[Fig.10]
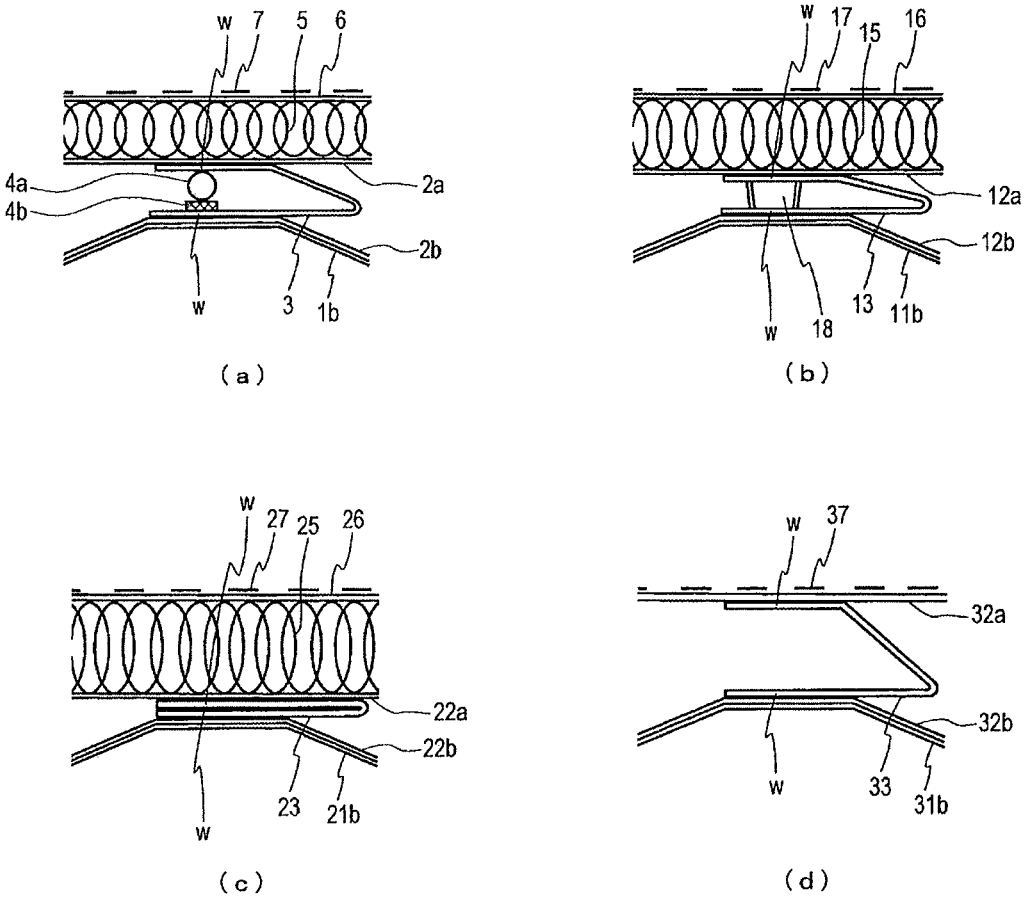

PRIOR ART
[Fig.11]
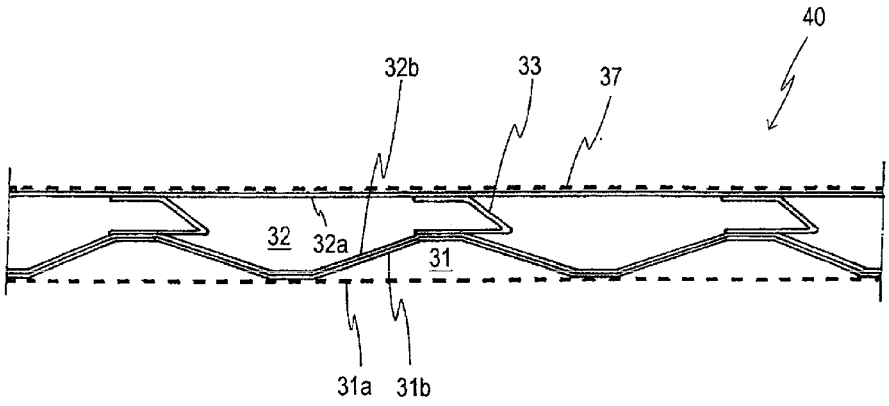

CELL FOR ION EXCHANGE MEMBRANE ELECTROLYSIS

TECHNICAL FIELD

The present invention relates to a cell for ion exchange membrane electrolysis (hereinafter also simply referred to as "cell"), particularly to a cell for ion exchange membrane electrolysis obtained by improving the performance in electrolysis of an existing bipolar cell for ion exchange membrane electrolysis, in which a cathode partition wall and a rigid cathode are connected together by a plurality of intermediating V-shaped springs, by a simple method.

BACKGROUND ART

In a cell for ion exchange membrane electrolysis used for chlorine-alkaline electrolysis, three components of the cell for ion exchange membrane electrolysis, which are an anode, an ion exchange membrane and a hydrogen-generating cathode, are normally arranged in close contact with each other to promote reduction in electrolysis voltage. However, in a large-scale cell which attains as much as several square meters of electrolysis area, when an anode and a cathode made of a rigid member were accommodated in the cell, it was difficult to maintain the distance between the electrodes at a determined value, with both electrodes brought into close contact with an ion exchange membrane.

A cell is known in which an elastic material is employed on an item used as a means to reduce the distance between electrodes or between an electrode and a current collector or as a means to maintain the distance between them at a nearly constant value. Such a cell has a structure in which at least one of the electrodes moves freely in the direction from one electrode to the other in order to avoid breakage of an ion exchange membrane by uniformly close contact of the electrode with the ion exchange membrane and to maintain the minimum distance between the anode and the cathode, and the pinch pressure is controlled by pressing the electrode through the elastic member. Non-rigid materials such as woven fabric, non-woven fabric, mesh and the like, which are formed of a metal fine wire; and rigid materials such as leaf spring and the like are known as examples of this elastic material.

However, conventional non-rigid materials had disadvantages. For example, when excessive pressure is applied to a conventional non-rigid material from the anode side after attaching it to a cell, the non-rigid material is partially deformed to have a non-uniform distance between electrodes and/or an ion exchange membrane is pricked with a fine wire of the non-rigid material. Moreover, rigid materials such as leaf spring and the like had disadvantages. For example, a rigid material damages an ion exchange membrane and/or causes plastic deformation of an ion exchange membrane so that the ion exchange membrane cannot be reused. Furthermore, for a cell for ion exchange membrane electrolysis such as a brine cell, the close proximity of an anode and/or a cathode to an ion exchange membrane is preferred to allow continuous operation of the cell at a low voltage and therefore various methods to press an electrode toward an ion exchange membrane are proposed.

For example, Patent Document 1 proposes a cell in which a metal coil body instead of a conventionally used leaf spring or metal mesh body is attached between a cathode and a cathode end plate and the cathode is uniformly pressed toward a barrier membrane to bring each member into close contact with the barrier membrane. Moreover, Patent Document 2 proposes a cell for ion exchange membrane electrolysis improved upon the technology of Patent Document 1, in which an elastic cushion member is attached between a hydrogen-generating cathode and a current collecting plate on the cathode side and the hydrogen-generating cathode is uniformly pressed toward an ion exchange membrane, wherein this elastic cushion member is prepared by winding a metal coil body around a corrosion-resistant frame.

RELATED ART DOCUMENTS

Patent Documents

Patent Document 1: Japanese Unexamined Patent Application Publication No. Sho 63-53272
Patent Document 2: Japanese Unexamined Patent Application Publication No. 2004-300543

SUMMARY OF THE INVENTION

Problems to be Solved by the Invention

Nowadays, a so-called zero-gap type cell as shown in FIG. 11 is known, in which cell units (40) each possessing an anode chamber (31) having a rigid anode (31*a*) and an anode partition wall (31*b*) and a cathode chamber (32) having a rigid cathode (32*a*) and a cathode partition wall (32*b*) are arranged in series with an ion exchange membrane (37) interposed between the respective units. This cell unit comprises a rigid cathode (32*a*) and a cathode partition wall (32*b*) connected together by a plurality of intermediating V-shaped springs (33), in which the rigid cathode (32*a*), the ion exchange membrane (37) and the rigid anode of the adjacent cell unit are brought into close contact with each other by the counterforce of the V-shaped springs (33). Such a cell for ion exchange membrane electrolysis can be improved by applying the metal coil body or the elastic cushion member proposed in Patent Documents 1 and 2 to the cell for ion exchange membrane electrolysis for avoiding breakage of the ion exchange membrane (37) and for enhancing performance in electrolysis. Moreover, for further enhancement of the performance in electrolysis, changing the material of the V-shaped spring (33) to a material with low resistance is contemplated as well. However, replacement of V-shaped springs (33) in an existing bipolar cell for ion exchange membrane electrolysis is a major renovation work and is undesirable in terms of both time and cost.

Thus, the object of the present invention is to improve the performance in electrolysis of an existing bipolar cell for ion exchange membrane electrolysis, in which a cathode partition wall and a rigid cathode are connected together by a plurality of intermediating V-shaped springs, by a simple method.

Means for Solving the Problems

The inventors have studied intensively to resolve the above-described problems and eventually found that performance in electrolysis can be improved by minimizing the path length of the current flowing through a V-shaped spring of the above-described cell for ion exchange membrane electrolysis and thereby completed the present invention.

That is, the cell for ion exchange membrane electrolysis of the present invention is a cell for ion exchange membrane electrolysis separated by an ion exchange membrane into an anode chamber having a rigid anode and an: anode partition wall and a cathode chamber having a rigid cathode and a cathode partition wall, the rigid cathode and the cathode partition wall being connected together by a plurality of intermediating V-shaped springs, wherein a conductive member is disposed near one end on the opening side of the V-shaped spring and the conductive member and the V-shaped spring are electrically connected when the V-shaped spring is compressed.

In the present invention, the conductive member is preferably elastic.

Moreover, another cell for ion exchange membrane electrolysis of the present invention is a cell for ion exchange membrane electrolysis separated by an ion exchange membrane into an anode chamber having a rigid anode and an anode partition wall and a cathode chamber having a rigid cathode and a cathode partition wall, the rigid cathode and the cathode partition wall being connected together by a plurality of intermediating V-shaped springs, wherein a concave portion toward the cathode partition wall is prepared in a region of the rigid cathode, to which the a plurality of V-shaped springs are not attached, and an electrical connection is provided between the concave portion and the cathode partition wall.

Furthermore, still another cell for ion exchange membrane electrolysis of the present invention is a cell for ion exchange membrane electrolysis separated by an ion exchange membrane into an anode chamber having a rigid anode and an anode partition wall and a cathode chamber having a rigid cathode and a cathode partition wall, wherein the rigid cathode and the cathode partition wall being connected together by a plurality of intermediating V-shaped springs, wherein compressing the V-shaped spring provides an electrical connection between the ends on the opening side of the V-shaped spring.

In a cell for ion exchange membrane electrolysis of the present invention, a metal elastic body and a flexible cathode are preferably disposed in layers on the surface of a rigid cathode, the surface being opposite to the surface to which V-shaped springs are attached, and either an elastic cushion member comprising a metal elastic body wound around a corrosion-resistant frame or a comb-shaped body comprising a plurality of pairs of plate spring-like bodies which extend inclining from a plate spring-like body holding member can be preferably used as the metal elastic body. Moreover, in the cell for ion exchange membrane electrolysis of the present invention, the metal elastic body is preferably a metal coil body.

Effects of the Invention

According to the present invention, the performance in electrolysis of an existing bipolar cell for ion exchange membrane electrolysis, in which a cathode partition wall and a rigid cathode are connected together by a plurality of intermediating V-shaped springs, can be improved by a simple method.

BRIEF DESCRIPTION OF THE DRAWINGS

FIG. 1 is a schematic partial cross-sectional view showing an electrical connection of a cell unit within a cell for ion exchange membrane electrolysis according to the first embodiment of the present invention.

FIG. 2 is an explanatory drawing representing a structure near the V-shaped spring of the cell for ion exchange membrane electrolysis according to the first embodiment of the present invention, and (a) represents a plan view of the structure near the V-shaped spring, (b) represents a side view of the structure near the V-shaped spring seen from the opening side of the V-shaped spring, (c) represents a cross-sectional view taken in the direction from one A to another A, and (d) represents a cross-sectional view taken in the direction from one B to another B.

FIG. 3 is a schematic drawing which explains an electric connection between a V-shaped spring and a conductive member and (a) represents a V-shaped spring before compression and (b) represents a V-shaped spring after compression.

FIG. 4 shows one preferred example of an elastic conductive member according to the present invention and (a) represents a plan view of the elastic conductive member and (b) represents a side view of the elastic conductive member.

FIG. 5 represents a schematic partial cross-sectional view showing an electrical connection of a cell unit within a cell for ion exchange membrane electrolysis according to the second embodiment of the present invention.

FIG. 6 represents an enlarged partial perspective view of one exemplary structure near the V-shaped spring of the cell for ion exchange membrane electrolysis according to the second embodiment of the present invention.

FIG. 7 represents a schematic partial cross-sectional view showing an electrical connection of a cell unit within a cell for ion exchange membrane electrolysis according to the third embodiment of the present invention.

FIG. 8 represents (a) a perspective view showing one preferred example of a corrosion-resistant frame used in an elastic cushion member and (b) a perspective view showing one preferred example of an elastic cushion member.

FIG. 9 represents a perspective view of one preferred example of a plate spring-like body.

FIG. 10 shows enlarged views of the structures near V-shaped springs of Examples 1 to 3 or Conventional Example, and (a) represents the structure in Example 1, (b) represents the structure in Example 2, (c) represents the structure in Example 3, and (d) represents the structure in Conventional Example.

FIG. 11 represents a schematic partial cross-sectional view showing an electrical connection of a cell unit within a conventional cell for ion exchange membrane electrolysis.

MODE FOR CARRYING OUT THE INVENTION

Now, embodiments of the present invention will be described in detail with reference to the drawings.

A cell for ion exchange membrane electrolysis of the present invention comprises a given number of bipolar cell units disposed in layers with an ion exchange membrane interposed between respective units. FIG. 1 represents a schematic partial cross-sectional view showing an electrical connection of a cell unit within a cell for ion exchange membrane electrolysis according to the first embodiment of the present invention. As shown by the drawing, a cell unit (10) is partitioned into an anode chamber (1) having a rigid anode (1*a*) and an anode partition wall (1*b*) and a cathode chamber (2) having a rigid cathode (2*a*) and a cathode partition wall (2*b*). Moreover, the rigid cathode (2*a*) and the cathode partition wall (2*b*) are connected together by V-shaped springs (3). Additionally, in the illustrated example, the anode partition wall (1*b*) and the cathode partition wall (2*b*) are in a shape having irregularity, which increases the rigidity of an electrode chamber formed of a thin metal plate of titanium, nickel and the like.

FIG. 2 is an explanatory drawing representing a structure near the V-shaped spring (3) of the cell for ion exchange membrane electrolysis according to the first embodiment of the present invention, and (a) represents a plan view of the structure near the V-shaped spring, (b) represents a side view of the structure near the V-shaped spring seen from the opening side of the V-shaped spring, (c) represents a cross-sectional view taken in the direction from one A to another A, and (d) represents a cross-sectional view taken in the direction from one B to another B. As shown by the drawing, a conductive member (4) (a metal rod in the illustrated example) is disposed near one end on the opening side of the V-shaped spring (3) and this conductive member (4) is anchored to the rigid cathode (2*a*) through the interspace between adjacent V-shaped springs (3) (at the position "w" in the illustrated example) by tungsten inert gas (TIG) welding and the like. In the cell of the present invention, compressing a V-shaped spring (3), that is, flattening a V-shaped spring (3) provides an electrical connection between the V-shaped spring (3) and the conductive member (4).

FIG. 3 is a schematic drawing which explains an electric connection between a V-shaped spring and a conductive member and (a) represents a V-shaped spring before compression and (b) represents a V-shaped spring after compression. A conventional cell was a cell in which an electrolytic current flowed along the shape of a V-shaped spring (3), whereas the cell according to the first embodiment of the present invention is a cell in which an electrolytic current flows along the shortest path via the conductive member (4) (see, FIGS. 1 and 3(*b*)), which can suppress electric power loss in the V-shaped spring (3). A rod-shaped or plate-shaped body made of a metal having a low specific resistance, such as nickel, nickel alloy, stainless steel, or copper, which exhibits good corrosion resistance; and coated with nickel and the like, which exhibit good corrosion resistance, by plating, or a rod-shaped or plate-shaped body made of stainless steel and covered with a mesh made of nickel can be employed on the conductive member (4).

The cross-sectional shape of the conductive member (4) in FIG. 3 is circular but the cross-sectional shape of the conductive member (4) in the cell of the present invention is not restricted to this shape. An oval shape, a triangle shape, a rectangular shape and the like, in addition to a circular shape, may be adopted as a cross-sectional shape of the conductive member (4) and the conductive member (4) is preferably brought into line contact with the rigid cathode (2*a*) so as not to prevent hydrogen gas generated near the surface of the rigid cathode (2*a*) from passing to the opposite side of an ion exchange membrane. Therefore, the cross-sectional shape of the conductive member (4) is preferably circular or oval.

In the cell according to the first embodiment of the present invention, a conductive member (4) is preferably elastic. In cases where a conductive member (4) is a rigid member such as a metal rod, it may be difficult in terms of manufacture to bring the entire part of the conductive member (4) into contact with a V-shaped spring (3). In this case, the V-shaped spring (3) and the conductive member (4) are in partial contact with each other and the contact resistance between them cannot be sufficiently reduced. Thus, imparting elasticity to the conductive member (4) increases the area of contact between the V-shaped spring (3) and the conductive member (4), which can further reduce the contact resistance between them and consequently minimize electric power loss in the V-shaped spring (3).

FIG. 4 shows one preferred example of an elastic conductive member and (a) represents a plan view of the elastic conductive member and (b) represents a side view of the elastic conductive member. An the elastic conductive member (4) shown in FIG. 4 is a conductive member in which a conductive mesh (4*b*) is anchored to a metal rod (4*a*) by welding and the like with providing sagging portions of the mesh. However, the embodiment of the present invention is not limited to this mode and a tubular body and the like made of nickel and the like may be used beside this mode.

Moreover, in the cell according to the first embodiment of the present invention, a metal elastic body (5) (a metal coil body in the illustrated example) and a flexible cathode (6) are preferably disposed sequentially in layers on the surface of the rigid cathode (2*a*), the surface being opposite to the surface to which V-shaped springs (3) are, attached. This is designed to allow zero-gap assembly without any space between a rigid cathode (2*a*) and an ion exchange membrane (7), which is generated by compressing a V-shaped spring (3). That is, a metal elastic body (5) uniformly presses a flexible cathode (6) toward an ion exchange membrane (7) and it results in close contact between the flexible cathode (6) and the rigid anode of the cell unit adjacent to the ion exchange membrane (7) without breakage of the ion exchange membrane (7). This allows the cell for ion exchange membrane electrolysis to improve its performance in electrolysis.

Next, a cell for ion exchange membrane electrolysis according to the second embodiment of the present invention will be described.

Also in the second embodiment of the present invention, a cell for ion exchange membrane electrolysis comprises a given number of bipolar cell units disposed in layers with an ion exchange membrane interposed between respective units. FIG. 5 represents a schematic partial cross-sectional view showing an electrical connection of a cell unit within the cell for ion exchange membrane electrolysis according to the second embodiment of the present invention. As shown by the drawing, a cell unit (20) is partitioned into an anode chamber (11) having a rigid anode (11*a*) and an anode partition wall (11*b*) and a cathode chamber (12) having a rigid cathode (12*a*) and a cathode partition wall (12*b*). Moreover, the rigid cathode (12*a*) and the cathode partition wall (12*b*) are connected together by V-shaped springs (13). Additionally, in the illustrated example, the anode partition wall (11*b*) and the cathode partition wall (12*b*) are in a shape having irregularity, which increases the rigidity of an electrode chamber formed of a thin metal plate of titanium, nickel and the like.

In the cell according to the second embodiment of the present invention, a concave portion (18) is provided in a region of the rigid cathode (12*a*) which a plurality of V-shaped springs (13) are not touching. FIG. 6 represents an enlarged partial perspective view of one exemplary structure near the V-shaped spring of the cell for ion exchange membrane electrolysis according to the second embodiment of the present invention. In the present embodiment, as shown in FIG. 6, a concave portion (18) is prepared in a region of a rigid cathode (12*a*) (a region between adjacent V-shaped springs: a circled region "S" in FIG. 6), to which a plurality of V-shaped springs (13) are not attached, and this concave portion (18) is directly brought into contact with a cathode partition wall (12*b*). This allows an electrolytic current, which conventionally flows along a V-shaped spring (13), to bypass the V-shaped spring (13) and flow to the cathode partition wall (12*b*) (see, FIG. 5) and it can minimize electric power loss.

Additionally, in the present embodiment, the procedure to provide a concave portion (18) to a rigid cathode (12*a*) is not particularly limited and a concave portion (18) may be prepared, for example, using a hammer. Moreover, this concave portion (18) is anchored to the cathode partition wall (12*b*) by TIG welding and the like so that the contact resistance between them can be reduced. Differing from the cell according to the first embodiment, the cell according to the second embodiment of the present invention does not need other members to be newly installed but a concave portion (18) toward a cathode partition wall (12*b*) to be provided to an existing rigid cathode (12*a*) and therefore has an advantage that the cell is manufactured easily.

Also in the present embodiment, a metal elastic body (15) (a metal coil body in the illustrated example) and a flexible cathode (16) are preferably disposed sequentially in layers on the surface of a rigid cathode (12*a*), the surface being opposite to the surface to which V-shaped springs (13) are attached. This is designed to allow zero-gap assembly by a metal elastic body (15) and a flexible cathode (16) without any space between a rigid cathode (12*a*) and an ion exchange membrane (17), which is generated by compressing a V-shaped spring (13).

Next, a cell for ion exchange membrane electrolysis according to the third embodiment of the present invention will be described.

Also in the third embodiment of the present invention, a cell for ion exchange membrane electrolysis likewise comprises a given number of bipolar cell units disposed in layers with an ion exchange membrane interposed between respective units. FIG. 7 represents a schematic partial cross-sectional view showing an electrical connection of a cathode chamber within the cell for ion exchange membrane electrolysis according to the third embodiment of the present invention. In the illustrated example, a cell unit (30) is partitioned into an anode chamber (21) having a rigid anode (21*a*) and an anode partition wall (21*b*) and a cathode chamber (22) having a rigid cathode (22*a*) and a cathode partition wall (22*b*). Moreover, the rigid cathode (22*a*) and the cathode partition wall (22*b*) are connected together by V-shaped springs (23). Additionally, in the illustrated example, the anode partition wall (21*b*) and the cathode partition wall (22*b*) are in a shape having irregularity, which increases the rigidity of an electrode chamber formed of a thin metal plate of titanium, nickel and the like.

Moreover, in the cell according to the third embodiment of the present invention, compressing a V-shaped spring (23) provides a contact and then an electrically connection between the ends on the opening side of the V-shaped spring (23). In that case, the V-shaped spring (23) is completely flattened. Creating such a situation allows an electrolytic current, which conventionally flows along the shape of a V-shaped spring (23), to flow along the shortest path, which can minimize electric power loss. The ends of the V-shaped spring (23) are secured together by TIG welding and the like so that the contact resistance between them can be further reduced. Additionally, the cell according to the third embodiment also does not need new members to be installed and therefore has an advantage that the cell is manufactured easily.

Also in the cell according to the third embodiment of the present invention, a metal elastic body (25) (a metal coil body in the illustrated example) and a flexible cathode (26) are preferably disposed sequentially in layers on the surface of the rigid cathode (22*a*), the surface being opposite to the surface to which V-shaped springs (23) are attached. This is designed to allow zero-gap assembly by a metal elastic body (25) and a flexible cathode (26) without any space between a rigid cathode (22*a*) and an ion exchange membrane (27), which is generated by compressing a V-shaped spring (23). Additionally, in the present embodiment, a metal elastic body (25) must be thicker than those of the cells (10) and (20) according to the first and second embodiments because a V-shaped spring (23) is flattened.

In the cell for ion exchange membrane electrolysis according to the first to third embodiments of the present invention, examples of metal elastic bodies (5), (15) and (25) include a metal coil body and a metal elastic body (5), (15) or (25) in a cell for ion exchange membrane electrolysis of the present invention is not particularly limited as long as it is made of a conductive material and has an elastic property such that it can supply electric power while pressing a pliable flexible cathode (6), (16), or (26) toward an ion exchange membrane (7), (17), or (27). For example, a plate spring-like body as described below, which extends inclining from a plate spring-like body holding member, may be used other than a metal coil body.

In cases where a metal coil body is employed on a metal elastic body (5), (15) or (25), the metal coil body is obtained, for example, by manufacturing a spiral coil through roll forming from a wire made of a metal having a low specific resistance, such as nickel, nickel alloy, stainless steel, or copper, which exhibits good corrosion resistance, and coated with nickel and the like, which exhibit good corrosion resistance, by plating and the like. The cross-sectional shape of the obtained wire is preferred to be a circular shape, an oval shape, a rectangular shape with rounded corners, and the like from the viewpoint of preventing damage to an ion exchange membrane. Specifically, subjecting a nickel wire of 0.17 mm in diameter (NW2201) to roll forming can yield a coil wire, which has a cross-sectional shape of a rectangle of about 0.05 mm×0.5 mm with rounded corners and a winding diameter of about 6 mm.

In FIGS. 1, 5 and 7, a metal elastic body (5), (15) or (25) (a metal coil body in the illustrated examples) without any modification is disposed between a rigid cathode (2*a*), (12*a*), or (22*a*) and a flexible cathode (6), (16), or (26) in a cell, whereas an elastic cushion member instead of a metal coil body may be used in the cell for ion exchange membrane electrolysis of the present invention, which elastic cushion member is constructed by winding a metal coil body around a corrosion-resistant frame. FIG. 8 represents (a) a perspective view showing one preferred example of a corrosion-resistant frame used in an elastic cushion member and (b) a perspective view showing an example of an elastic cushion member.

In the examples shown in FIGS. 8(*a*) and 8(*b*), a corrosion-resistant frame (50) according to the present invention comprises a rectangular frame (51) formed of a round metal bar and a supporting rod (52) which is bridged between a pair of longitudinal round bars of the rectangular frame. A nickel round bar of about 1.2 mm in diameter, for example, can be preferably employed on this round metal bar. An elastic cushion member (53) according to the present invention can be obtained by winding a metal elastic body (54) (a metal coil body in the illustrated example) between a pair of longitudinal round bars of a corrosion-resistant frame (50) along their entire length (FIG. 8(*b*)). In the elastic cushion member (53) obtained in this way, the shape of the elastic cushion member is unchanged from that of the corrosion-resistant frame (50) because the metal elastic body (54) is wound around the corrosion-resistant frame (50), and the metal elastic body (54) is scarcely disengaged from the corrosion-resistant frame (50) so that the metal elastic body (54) can be handled as a unit integrated with the corrosion-resistant frame (50). Winding a metal elastic body (54) around a corrosion-resistant frame (50) can offer advantages described below.

That is, a metal elastic body (54) has a high deformation ratio and therefore is difficult to handle and often causes difficulty in installation to a determined part of a cell in accordance with a worker's intention. Furthermore, the metal elastic body is easily deformed (its strength is insufficient) and it sometimes causes difficulty in uniformly close contact with respective members due to deviation of the metal elastic body by an electrolyte and/or generated gas in a cell even if the metal elastic body is once installed to a determined part of the cell. In contrast, an elastic cushion member (53) comprises a rectangular corrosion-resistant frame, which is composed of four rods, as shown, for example, in FIG. 8(*a*). The elastic cushion member is obtained by winding a metal elastic body (54) between two facing rods out of the four so as to provide a nearly uniform density (see, FIG. 8(*b*)). Additionally, the present invention has been described using a metal coil body as an example of a metal elastic body employed on an elastic cushion member but the above-described metal elastic body, such as a metal non-woven fabric, may be employed other than a metal coil body.

In cases where a metal coil body was used as a metal elastic body, the diameter of the metal coil body (the nominal diameter of the coil) would be usually reduced by 10 to 70% and elasticity would be provided in the metal coil body itself or an elastic cushion member (53) obtained by winding the metal coil body when it was attached into a cell. This elasticity allows an elastic connection between a rigid cathode (2*a*), (12*a*), or (22*a*) and a flexible cathode (6), (16), or (26) to be established and to facilitate power supply to the electrodes. In cases where a metal coil body formed of a wire having a small diameter is used, the number of contact points between a rigid cathode (2*a*), (12*a*), or (22*a*) and an elastic cushion member or between a flexible cathode (6), (16), or (26) and an elastic cushion member is consequently increased, which enables uniform contact to be achieved. Moreover, the shape of an elastic cushion member (53) is maintained by its corrosion-resistant frame (50) after the elastic cushion member is attached into a cell, and therefore the elastic cushion member scarcely undergoes plastic deformation and can be, in most cases, reused in reassembly after disassembly of a cell.

Moreover, in a cell of the present invention, a plate spring-like body may be used as a metal elastic body, as described above. FIG. 9 represents a perspective view of one preferred example of a plate spring-like body, which can be used in a cell for ion exchange membrane electrolysis of the present invention. In the cell for ion exchange membrane electrolysis of the present invention, all plate spring-like bodies may extend inclining in the same direction but adjacent plate spring-like bodies (60) preferably extend inclining in mutually opposite directions as shown in FIG. 9. The reason is that a force acts on a flexible cathode only in a vertical direction when plate spring-like bodies (60) extend in mutually opposite directions and thus the flexible cathode moves only in a horizontal direction, by which troubles such as damage to the surface of an ion exchange membrane can be avoided.

Furthermore, a plate spring-like body (60) preferably has an attachment part (60*a*) at its distal portion, which is folded nearly parallel to a plate spring-like body holding member (61) to make contact with a flexible cathode, as shown by the drawing. Providing an attachment part (60*a*) allows a plate spring-like body (60) to avoid damaging a flexible cathode as well as to improve the connection between a flexible cathode and an ion exchange membrane. Additionally, a plate spring-like body produced by attaching a spring-like body to a plate with any method may be used, though another plate spring-like body is used in the illustrated example, which is produced by making incisions in a plate to form a tab and pulling up the tab.

The present invention has been described so far using a metal coil body, an elastic cushion member and a plate spring-like body as an example of a metal elastic member related to the cell for ion exchange membrane electrolysis of the present invention. In addition to these articles, a fine metal wire shaped in a wave form or a metal non-woven fabric may be used in a cell for ion exchange membrane electrolysis of the present invention. In addition to these articles, a knitted fabric, a woven fabric, a layered product made of these fabrics, a fabric knitted three-dimensionally, and a fabric which has undergone undulation after three dimensional knitting, which fabrics are formed of a metal wire, may be used as a metal elastic body.

In the cell for ion exchange membrane electrolysis of the present invention, when a cell for ion exchange membrane electrolysis comprising a metal elastic body or an elastic cushion member is assembled, an elastic cushion member and the like is disposed between a rigid cathode (2*a*), (12*a*), or (22*a*) and a flexible cathode (6), (16), or (26) and then the remaining parts of the cell are normally assembled to obtain a cell for ion exchange membrane electrolysis which holds an elastic cushion member and the like at a predetermined position.

Assembly of an elastic cushion member can be easily performed using a metal elastic body, because it is performed outside of a cell. The obtained elastic cushion member should be installed at assembly of a cell to provide electrical connection to a current collector mounted on an electrode of interest in the cell. During this installation, the elastic cushion member itself is not deformed so much due to the strength of its corrosion-resistant frame as to affect the assembly of the cell and therefore the elastic cushion member can be easily installed to a predetermined position. In the present invention, electricity is normally transmitted in a contact power distribution system.

The cell for ion exchange membrane electrolysis of the present invention relates to an improved cell for ion exchange membrane electrolysis, which is separated by an ion exchange membrane into an anode chamber having an anode and an anode partition wall and a cathode chamber having a rigid cathode and a cathode partition wall, wherein the rigid cathode is supported by a plurality of V-shaped springs attached to the cathode partition wall. Only realizing the above-described configurations of the cell for ion exchange membrane electrolysis of the present invention is important and conventionally used configurations can be appropriately employed without particular limitation on the other structures of the cell for ion exchange membrane electrolysis.

For example, a flexible cathode (6), (16), or (26) is not particularly limited as long as it is compressed by a metal elastic body (5), (15) or (25) or an elastic cushion member so as to make contact with an ion exchange membrane (7), (17), or (27) and generally any flexible cathode can be used as long as it is used for electrolysis. However, preferred is a pyrolytic activated cathode selected from a group consisting of Ru—La—Pt-based, Ru—Ce-based, Pt—Ce-based and Pt—Ni based cathodes, which has a thin but highly active catalytic film and does not induce mechanical damage to an ion exchange membrane due to the smooth surface of the film.

EXAMPLES

Now, the present invention will be described in more detail by means of Examples.

Example 1

A conductive member, in which a rod-shaped body of 3.0 mm in diameter made of stainless steel SUS310S and a conductive mesh were welded together, was disposed near one end on the opening side of a V-shaped spring of an existing cell for ion exchange membrane electrolysis (BiTAC®: produced by Chlorine Engineers Corp., Ltd.), which is separated by an ion exchange membrane into an anode chamber having a rigid anode and an anode partition wall and a cathode chamber having a rigid cathode and a cathode partition wall and in which the rigid cathode is supported by a plurality of V-shaped springs attached to the cathode partition wall. Subsequently, a cathode mesh was anchored to the conductive member by TIG welding at positions where an interspace between adjacent V-shaped springs was shown.

A coil wire of about 0.5 mm in diameter was manufactured through roll forming from a nickel wire (NW2201) having a wire diameter of 0.17 mm and a tensile strength of 620 to 680 $N/m^2$. A metal coil body having a winding diameter of about 6 mm was produced by using the obtained coil wire. This metal coil body was wound around a frame formed of nickel round bar having a diameter of 1.2 mm (corrosion-resistant frame) to form a cubic body and thereby an elastic cushion member of roughly 350 mm in length×110 mm in width×10 mm in height was produced. The density of the coil wire in this elastic cushion member was about 7 $g/dm^2$. The obtained elastic cushion member was inserted between the rigid cathode and the flexible cathode, while retaining the elasticity, to perform electrolysis at a current density of 4 $kA/m^2$ for 30 days.

A dimensionally stable electrode produced by Permelec Electrode Ltd., an activated cathode formed of a nickel micromesh substrate and a nickel expanded metal were employed on an anode, a flexible cathode and a rigid cathode, respectively. The size of each reaction surface was 110 mm in width×1400 mm in height in the anode and the cathodes. An ion exchange membrane Flemion F-8020 produced by Asahi Glass Co., Ltd. was employed.

Example 2

Electrolysis was performed according to the same procedure as in Example 1 except that a conductive member was not disposed near one end on the opening side of a V-shaped spring and a rigid cathode was recessed using a hammer to form a concave portion at a position where a V-shaped spring was not attached to the rigid cathode and to bring this concave portion into contact with a cathode partition wall and this attachment was subsequently secured by TIG welding.

Example 3

Electrolysis was performed according to the same procedure as in the above Example except that a metal coil body having a winding diameter of 8 mm and a flexible cathode were disposed sequentially in layers on a V-shaped spring, which had been completely flattened.

Conventional Example

Electrolysis was performed as usual by using a cell BiTAC® produced by Chlorine Engineers Corp., Ltd.

Lead wires were welded to the both sides of a V-shaped spring in individual cells of Examples 1 to 3 and Conventional Example and the difference in electric potential between them was measured with a digital voltmeter. FIGS. 10(*a*) to 10(*d*) show enlarged views of the structures near V-shaped springs of Examples 1 to 3 or Conventional Example, and (a) represents the structure in Example 1, (b) represents the structure in Example 2, (c) represents the structure in Example 3, and (d) represents the structure in Conventional Example. Moreover, "w" in the drawings represents the position where lead wires are welded.

According to the results of the measurement, the difference in electric potential was 25 mV in Conventional Example while it was 13 mV in Example 1, 10 mV in Example 2, and 7 mV in Example 3, which can confirm that the voltage in each Example was able to be reduced as compared to that in Conventional Example.

DESCRIPTION OF SYMBOLS

1, 11, 21, 31 Anode chamber
1*a*, 11*a*, 21*a*, 31*a* Rigid anode
1*b*, 11*b*, 21*b*, 31*b* Anode partition wall
2, 12, 22, 32 Cathode chamber
2*a*, 12*a*, 22*a*, 32*a* Rigid cathode
2*b*, 12*b*, 22*b*, 32*b* Cathode partition wall
3, 13, 23, 33 V-shaped spring
4 Conductive member
4*a* Metal rod
4*b* Conductive mesh
5, 15, 25 Metal elastic body
6, 16, 26 Flexible cathode
7, 17, 27, 37 Ion exchange membrane
18 Concave portion
10, 20, 30, 40 Cell unit
50 Corrosion-resistant frame
51 Rectangular frame
52 Supporting rod
53 Elastic cushion member
54 Metal elastic body
60 Plate spring-like body
60*a* Distal portion
61 Plate spring-like body holding member

The invention claimed is:

1. A cell for ion exchange membrane electrolysis separated by an ion exchange membrane into an anode chamber having a rigid anode and an anode partition wall and a cathode chamber having a rigid cathode and a cathode partition wall, the rigid cathode and the cathode partition wall being connected together by a plurality of intermediating V-shaped springs, wherein a conductive member is disposed within opening side of the V-shaped spring so that the conductive member and the V-shaped spring are electrically connected when the V-shaped spring is compressed.

2. The cell for ion exchange membrane electrolysis according to claim 1, wherein the conductive member is elastic.

3. The cell for ion exchange membrane electrolysis according to claim 2, wherein a metal elastic body and a flexible cathode are further disposed in layers on the surface of the rigid cathode, the surface being opposite to the surface to which the V-shaped springs are attached.

4. The cell for ion exchange membrane electrolysis according to claim 1, wherein a metal elastic body and a flexible cathode are further disposed in layers on the surface of the rigid cathode, the surface being opposite to the surface to which the V-shaped springs are attached.

5. The cell for ion exchange membrane electrolysis according to claim 4, wherein the metal elastic body is an elastic cushion member comprising a metal elastic body wound around a corrosion-resistant frame.

6. The cell for ion exchange membrane electrolysis according to claim 4, wherein the metal elastic body is a metal coil body.

7. The cell for ion exchange membrane electrolysis according to claim 4, wherein the metal elastic body is a comb-shaped body comprising a plurality of pairs of plate spring-like bodies which extend inclining from a plate spring-like body holding member.

8. A cell for ion exchange membrane electrolysis separated by an ion exchange membrane into an anode chamber having a rigid anode and an anode partition wall and a cathode chamber having a rigid cathode and a cathode partition wall, the rigid cathode and the cathode partition wall being connected together by a plurality of intermediating V-shaped springs, wherein ends on opening side of the V-shaped spring are directly contacted to each other to establish an electrical connection between the ends on the opening side by compressing the V-shaped spring.

9. The cell for ion exchange membrane electrolysis according to claim 8, wherein a metal elastic body and a flexible cathode are further disposed in layers on the surface of the rigid cathode, the surface being opposite to the surface to which the V-shaped springs are attached.

* * * * *